US005586427A

United States Patent [19]

Pohn et al.

[11] Patent Number: 5,586,427

[45] Date of Patent: Dec. 24, 1996

[54] DEVICE FOR ADJUSTING THE CONTACT PRESSURE OF A PRESSURE ROLLER AGAINST THE DRAW-OFF SHAFT OF A ROTOR SPINNING MACHINE

[75] Inventors: Romeo Pohn; Edmund Schuller, both of Ingolstadt, Germany

[73] Assignee: Rieter Ingolstadt Spinnereimaschinenbau AG, Ingolstadt, Germany

[21] Appl. No.: 450,387

[22] Filed: May 25, 1995

[30] Foreign Application Priority Data

Sep. 3, 1994 [DE] Germany ..... 44 31 537.6

[51] Int. Cl.[6] ..... D01H 7/46; D01H 7/92

[52] U.S. Cl. ..... 57/264; 57/90; 57/263; 57/417

[58] Field of Search ..... 57/400, 263, 417, 57/414, 90, 315, 264

[56] References Cited

U.S. PATENT DOCUMENTS

| | | | |
|---|---|---|---|
| 3,409,237 | 11/1968 | Pospisil et al. . | |
| 3,685,267 | 8/1972 | Landwehrkamp et al. . | |
| 3,733,799 | 5/1973 | Roethke | 57/263 |
| 3,842,579 | 10/1974 | Bartling | 57/263 |
| 3,854,274 | 12/1974 | Bartling | 57/263 |
| 3,911,658 | 10/1975 | Smith | 57/263 |
| 4,142,358 | 3/1979 | Honjo | 57/406 |
| 4,656,824 | 4/1987 | Stapfer | 57/263 |
| 5,400,583 | 3/1995 | Cobb | 57/400 |
| 5,435,121 | 7/1995 | Cobb | 57/400 |

FOREIGN PATENT DOCUMENTS 1710035 9/1971 Germany .

*Primary Examiner*—William Stryjewski
*Attorney, Agent, or Firm*—Dority & Manning

[57] ABSTRACT

A yarn draw-off device for use with a spinning machine includes a pressure roller and a rotatably driven draw-off shaft. The pressure roller is in contact with the draw-off shaft and is rotatably driven by the shaft. An adjustable mounting device is provided for the pressure roller. The pressure roller is rotatably mounted on the mounting device. The mounting device is selectively movable relative to the draw-off shaft so as to vary the contact pressure between the pressure roller and the draw-off shaft.

12 Claims, 4 Drawing Sheets

DEVICE FOR ADJUSTING THE CONTACT PRESSURE OF A PRESSURE ROLLER AGAINST THE DRAW-OFF SHAFT OF A ROTOR SPINNING MACHINE

BACKGROUND OF THE INVENTION

A yarn draw-off device on a rotor spinning machine is constituted by a pressure roller and draw-off shaft. The invention relates to adjusting the contact pressure of a pressure roller against the draw-off shaft of a yarn draw-off device. The contact pressure is necessary in order to draw the yarn between rotating pressure roller and rotating draw-off shaft out of the rotor and to convey it in the direction of the winding device.

Rotor spinning machine are equipped with a plurality of individual spinning stations which produce a yarn from fiber sliver. The yarn must be withdrawn continuously from each individual rotor by means of draw-off devices and delivered to a winding device where it is wound into a yarn bobbin. The draw-off device of a rotor spinning machine consists of a draw-off shaft or its segments which are axially rotatable on each machine side. Both draw-off shafts are driven and are imparted their rotational movement. The corresponding drive is located in the drive frame of the rotor spinning machine.

The draw-off device is completed by the pressure roller, whereby one pressure roller assigned to run the yarn at a spinning station on the draw-off shaft is applied to the draw-off shaft. The individual pressure roller is supported by a pressure roller lever which is attached to the machine frame. The pressure roller is rotatably mounted on the pressure roller lever. The pressure roller rotates as it lies on the rotatable draw-off roller. For piecing or in a piecing operation, i.e. when a yarn breakage is being repaired, the pressure roller can be swivelled together with its pressure roller lever away from the draw-off shaft into an open position and can be swivelled back from there into its operating position. The yarn can thus be placed in the yarn draw-off device and can be clampingly held.

The draw-off roller together with the pressure roller draws the produced yarn out of the rotor groove through the draw-off pipe of the spinning box. In order to ensure the regularity of a yarn number, the yarn must have little slip, i.e. it must be drawn off at a constant speed from the rotor groove. In order to ensure this state, the pressure roller of each spinning station is pressed against the draw-off shaft with a constant force. The contact pressure of the pressure roller is produced in the state of the art by means of a tension spring. The tension spring is held on one side in a fixed angle bracket of the machine frame and pulls on the other side the pressure roller with a constant force via the pressure roller lever against the draw-off shaft.

Different values for a constant contact pressure would be required as a function of the yarn number in order to withdraw the yarn with little slip. This requirement is simplified in that the contact pressure is adjusted one time for the highest yarn number that can be produced and for the requirements in the piecing process. The tension spring used produces this constant contact pressure for the highest yarn number produced. This contact pressure is not changed.

This has however the disadvantage that the energy utilization for yarn withdrawal for all the other yarns is always over-sized with respect to ensuring low-slip yarn withdrawal at constant speed. Since this over-sizing of the energy utilization during yarn withdrawal applies during the entire production time, the resulting loss in energy reaches a magnitude that is economically felt.

OBJECTS AND SUMMARY OF THE INVENTION

It is a principal object of the invention to reduce the energy consumption of a yarn draw-off device consisting of a pressure roller and a draw-off shift perceptibly without adversely affecting the yarn withdrawal. Additional objects and advantages of the invention will be set forth in part in the following description, or may be obvious from the description, or may be learned through practice of the invention.

According to the invention, the contact force of the pressure roller against the draw-off shaft is rendered modifiable and adjustable. Thus, it becomes possible to reduce the contact force when a thinner yarn number is being produced and to increase the contact pressure with the switch-over to a thicker yarn number when batches are changed.

This advantageously leads to the result that energy is saved within the range of thinner numbers for a selected constant draw-off speed. With the reduction of the contact pressure in the production of thinner yarn numbers, energy savings of approximately 20 percent per yarn draw-off device of a spinning box is possible. In constant operation of a rotor spinning machine, this means an effective economic saving of energy without affecting the yarn withdrawal adversely.

It is another characteristic that the effective direction of the contact pressure on the pressure roller matches the direction of the center line of the running surface of the pressure roller. With this characteristic, the result is that the contact pressure cannot be reduced by lateral forces acting upon the pressure roller lever, so that a parallel contact pressure of the pressure roller against the draw-off roller is always ensured.

The advantage of energy savings can also be obtained when repairing a yarn breakage, i.e. in piecing. Depending on the technological requirements during the piecing process, the contact pressure of the pressure roller can be increased in the beginning to be reduced again with the completion of the piecing process at the latest to the value corresponding to the yarn number to be produced. Since piecing operations are rare on a spinning box and since they last considerably less than production time, achievable energy savings exist, but are considerably less than in running production.

The yarn draw-off device is provided with an adjusting device through which the contact pressure of the pressure roller is rendered modifiable and adjustable. The adjusting device attacks at the pressure roller lever. Preferably the adjusting device is a solenoid with thrust rod which can be controlled without steps by programmed controls.

Another mechanical embodiment can use a lever as an adjust device which puts the tension spring under tension. This lever can be tipped over at a spinning station by a travelling piecing device during the piecing process so that the contact pressure may be increased during the spinning process.

The invention and additional characteristics are explained below through a preferred embodiment of the invention.

DETAILED DESCRIPTION OF THE PREFERRED EMBODIMENTS

Figure 1:
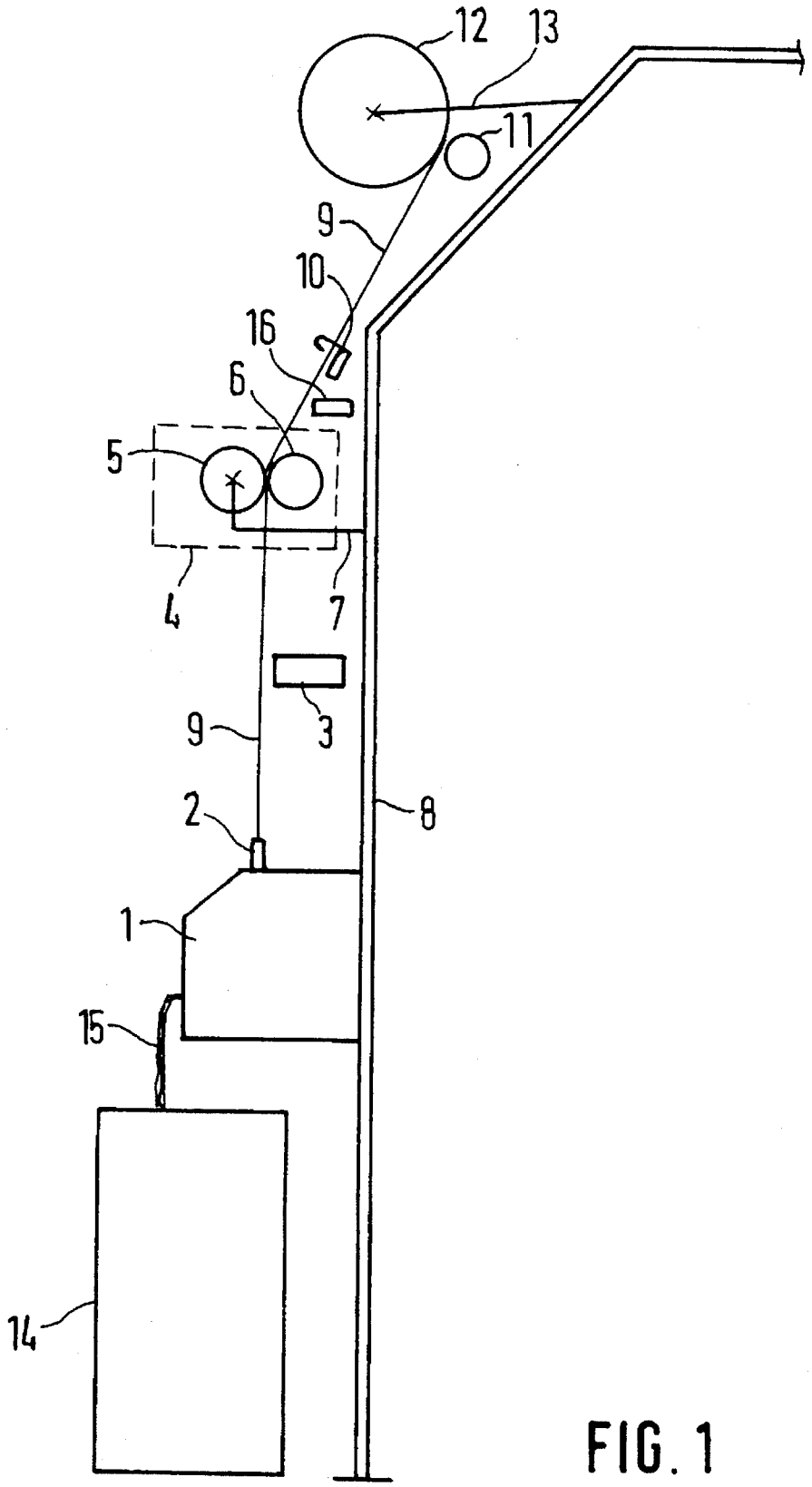
FIG. 1 shows the course of the yarn on a spinning box.

Reference will now be made in detail to the presently preferred embodiments of the invention, one or more examples of which are illustrated in the drawings. Each example is provided by way of explanation of the invention, and not as a limitation to the invention. In fact, various modifications and variations can be made in the present invention without departing from the scope and spirit of the invention.

FIG. 1 schematically shows the course of the yarn at an individual spinning box of a spinning machine. The essential operating elements assigned to the course of the yarn can be recognized here. A rotor spinning machine possesses a plurality of spinning boxes which are installed next to each other, each on one of the two machine sides. A spinning box 1 receives a fiber sliver 15 from a can 14. In the rotor spinning process, the fiber sliver is opened into individual fibers in the spinning box 1. These individual fibers are conveyed into a rotating rotor and the forming fiber ring is withdrawn from the rotor groove of the rotor through the yarn draw-off pipe 2. The withdrawal of the produced yarn is carried out by the yarn draw-off device 4. The yarn draw-off device 4 consists in particular of the draw-off shaft 6 and of a pressure roller 5. The pressure roller 5 is borne by a pressure roller lever 7 which is attached to the machine frame 8. Within this yarn section, the produced yarn is checked by the quality control system 3 for irregularities in the yarn. The yarn draw-off device 4 holds the yarn 9 clampingly and conveys it in the direction of the winding device. In the course of the yarn and following the yarn draw-off device 4 is a yarn monitor 16 which monitors the presence of the yarn. A yarn guide 10 ensures that the yarn is traversed over the entire width of the bobbin 12. The bobbin 12 is held by a bobbin mount 13 which is connected to the machine frame 8. The bobbin 12 is rotated by the bobbin roller 11 so that the yarn is wound up. This represents the wind-up device.

Figure 2:
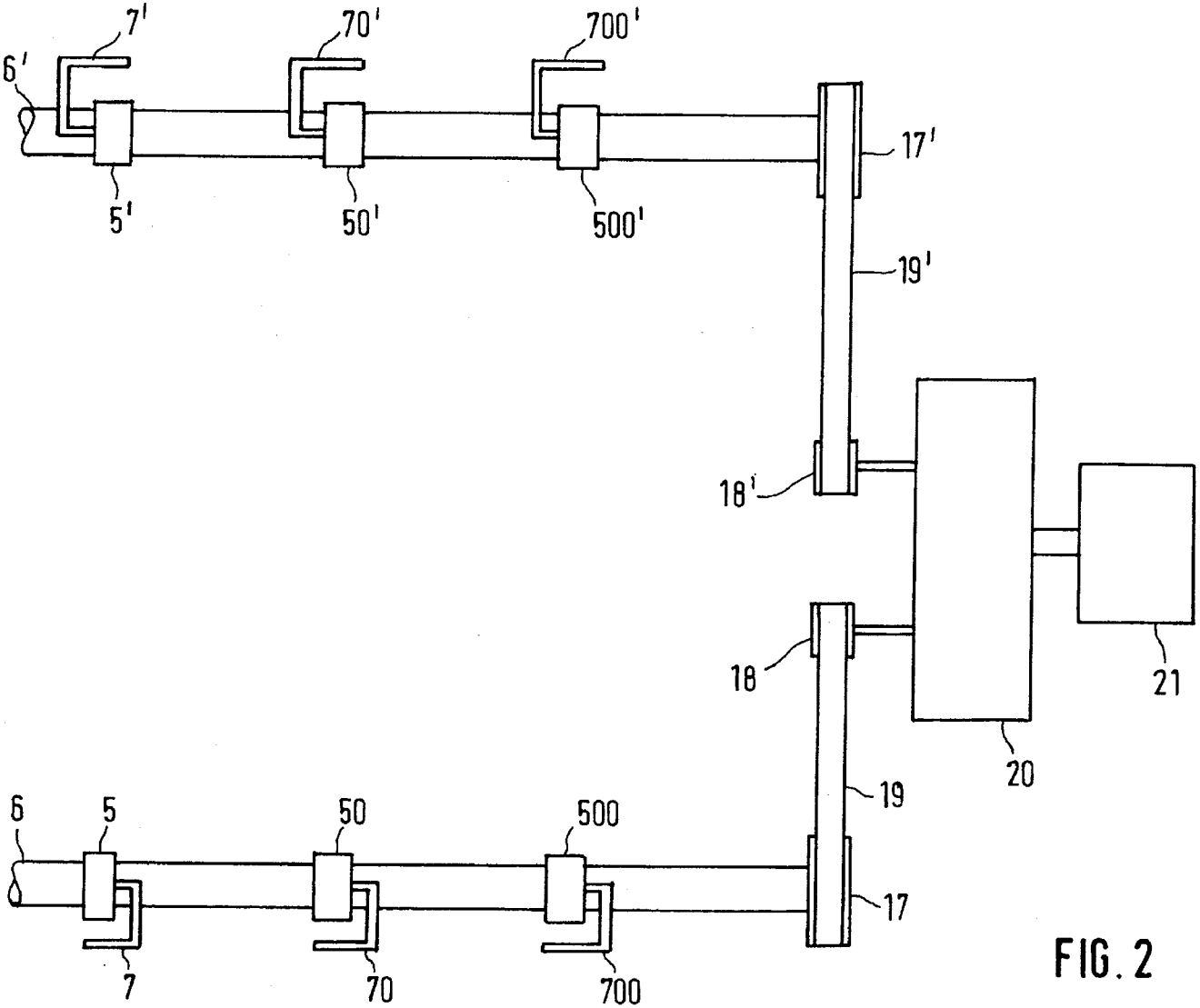
FIG. 2 shows a detailed view of the drive of the draw-off device for each machine side.

FIG. 2 shows a view of the drive of a draw-off device for each machine side of a rotor spinning machine in a detail. The drive consist of a motor 21 and a gear 20. The gear 20 has two outputs, with the power being transmitted on the driving disks 18 and 18'. The power is transmitted via belt 19' via deflection roller 17' to the draw-off shaft 6'. The draw-off shafts 6 and 6' are rotatably mounted in the machine frame. The drive associated with motor 21, gear 20, and belts 19, 19' is located as a rule in the drive frame, i.e. at one face of the rotor spinning machine. The pressure rollers 5, 50, 500, 5', 50', 500' are supported by the pressure roller levers 7,70, 700, 7', 70', 700'.

None of the pressure rollers is provided with its own drive, but the rotation of each individual pressure roller is due to the fact that it bears upon the draw-off shaft. To be able to withdraw the yarn from the spinning box, the yarn is clampingly held between the draw-off shaft and pressure roller. The yarn is withdrawn from the spinning box by the rotation of draw-off shaft and pressure roller. The pressure roller is rotatably mounted in its mount for that purpose.

Figure 3:
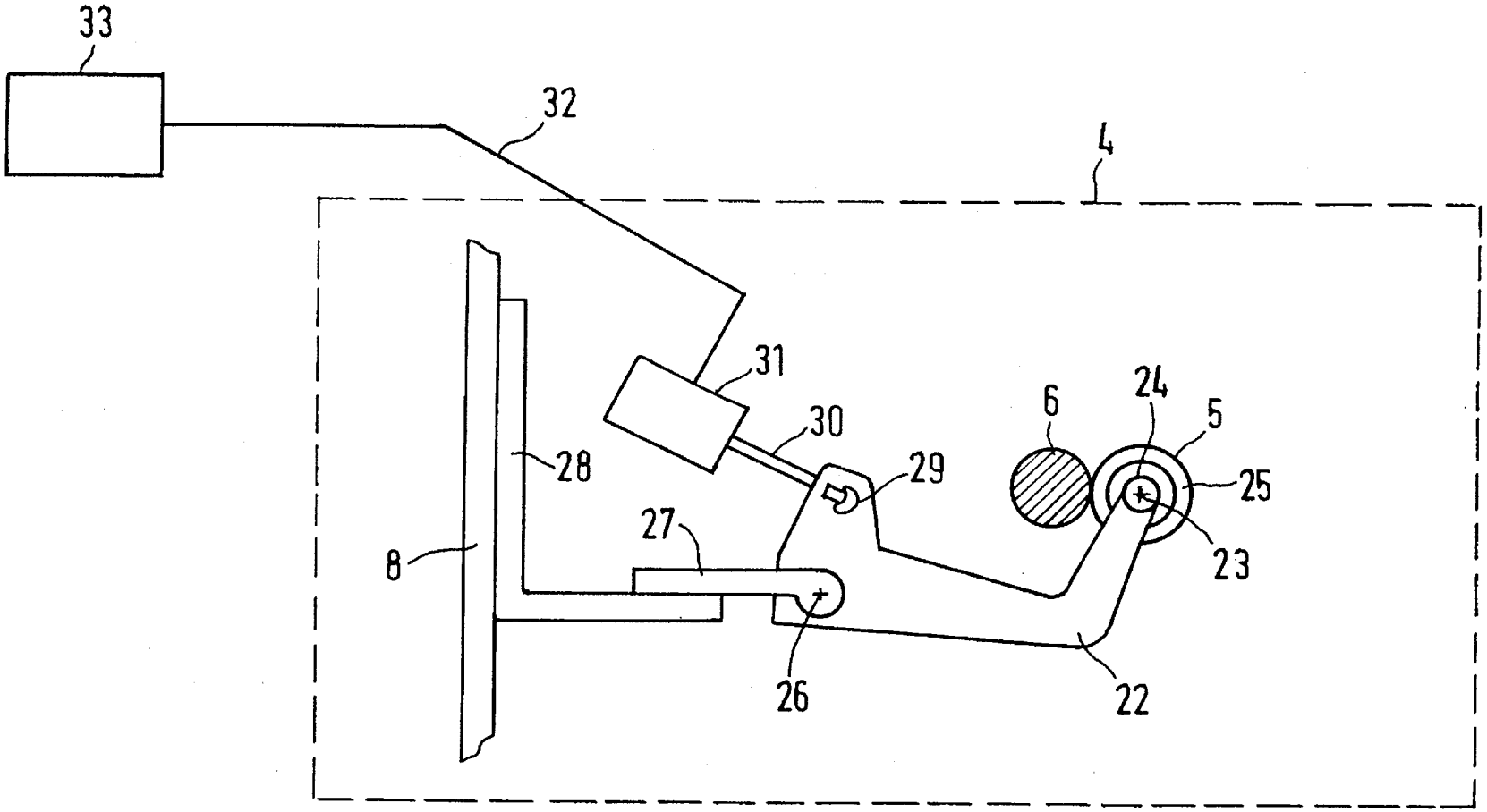
FIG. 3 shows details of the draw-off device according to the invention.

FIG. 3 shows the details of a yarn draw-off device 4 of a spinning box 1.

The pressure roller 5 bears upon the draw-off shaft 6. The circumference of the pressure roller 5 is constituted by a coating 25. The coating 25 increases the friction against the draw-off shaft 6. The pressure roller 5 is mounted rotatably in the pressure roller lever 22 by means of the rotation axle 23. A bolt 24 is formed on the pressure roller lever in a one-sided extension of the rotation axle 23. The pressure roller lever is mounted pivotably in a supporting arm 27 by means of the horizontal rotational axle 26. The supporting arm 27 is attached by means of a detachable connection to an angle bracket 28. The angle bracket 28 is already part of the machine frame. The yarn draw-off device 4 furthermore contains an adjusting device 31 with a thrusting rod 30. The adjusting device 31 is placed so that the thrusting rod 30 becomes engaged into the pressure roller lever 22. The engagement of the thrusting rod 30 may be effected via a bore 29 in the pressure roller lever 22, for example. In that case, the thrusting rod 30 would have to be made in the form of a hook at its end which enters into the bore 29. The adjusting device 31 is connected via a connection 32 to controls 33. The controls 33 are as a rule located outside the yarn draw-off device 4. The connection 32 may contain electric control circuits and circuits for the supply of auxiliary energy. The controls 33 control the adjusting device 31 by means of a program via connection 32. The contact pressure of the pressure roller 5 against the draw-off shaft 6 can be controlled by means of the controls 33 via the adjusting device 31. When the thrusting rod 30 is pushed in the direction of the pressure roller lever 22, the contact pressure of the pressure roller 5 against the draw-off shaft 6 is reduced. When the thrusting rod 30 pulls in the direction of the adjusting device 31, the pressure roller lever 22 is pressed against the draw-off shaft 6 by swivelling around the rotational axle 26. The contact pressure of the pressure roller 5 is increased. By means of the adjusting device 31, it is possible to change the contact pressure of the pressure roller 5 and to adjust it to a desired value.

Figure 5:
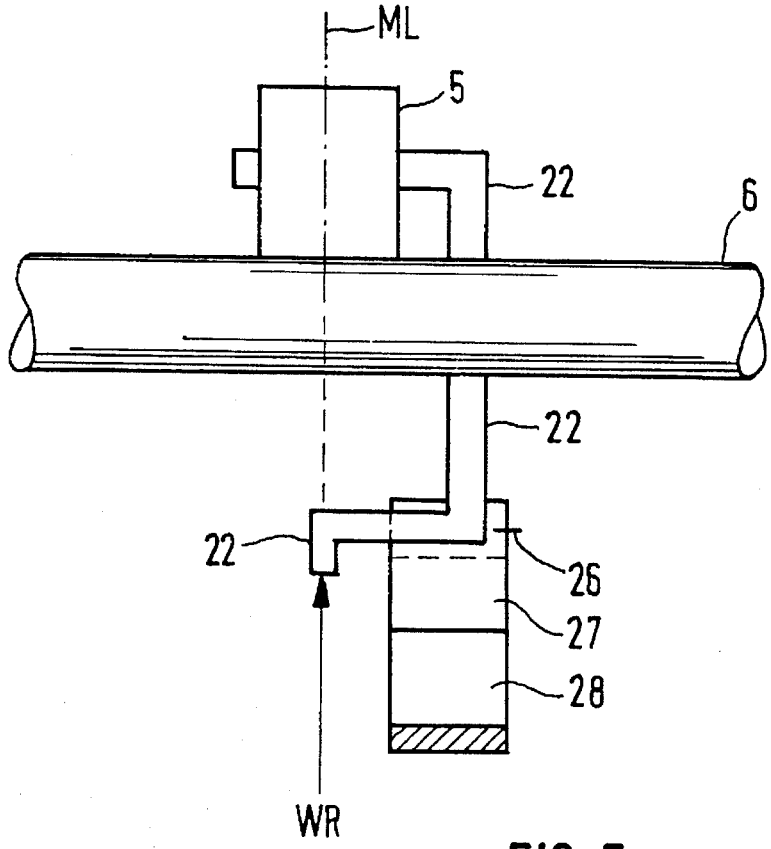
FIG. 5 shows agreement between point of attack of the contact pressure on the pressure roller lever and the center line of the running surface of the pressure roller.

In this connection it is advantageous for the direction of effect WR of the contact pressure transmitted by the thrusting rod 30 to coincide with the center line ML of the running surface of the pressure roller 5. This offers the advantage that the contact pressure transmitted by means of the thrusting rod 30 will not be reduced by transversal forces on the pressure roller lever 22, so that a parallel contact pressure of the pressure roller 5 against the draw-off shaft 6 is ensured. Jamming of the pressure roller is prevented. Such an embodiment is shown in FIG. 5.

If a thinner yarn number is produced after a batch change for example, the contact pressure of the pressure roller 5 against the draw-off shaft 6 can be reduced when switching from a thicker to a thinner yarn number. With this reduction of the contact pressure in the production of a thinner yarn number, the energy consumption of the drive of the draw-off shaft 6 can be reduced perceptibly. This is an advantage, since a saving in energy of approximately 20 percent occurs on the yarn draw-off device. This reduction of the contact pressure in function of the yarn number produced is taken into account in the program of controls 33. It is a further advantage that the adjustment of the contact pressure is automatic and continuous.

It is a further advantage that the release of the clamping between draw-off shaft 6 and pressure roller 5 can also be automatic, in that the control device 31 causes the thrusting rod 30 together with the pressure roller lever 22 to swivel the pressure roller 5 away from the draw-off shaft 6 and into an open position. In this open position the yarn can be inserted between the draw-off shaft 6 and the pressure roller 5. When the correct course of the yarn has been established, the pressure roller 5 is swivelled back into its operating position through the control device 31, i.e. the pressure roller 5 is pressed against the draw-off shaft 6 and holds the yarn clampingly. Since the draw-off shaft 6 rotates constantly, the pressure roller 5 is also caused to rotate by friction. The yarn is constantly withdrawn from the spinning box 1 and is conveyed to the bobbin 12 by the rotation of the draw-off shaft 6 and the pressure roller 5. The adjusting device 31 with thrusting rod 30 could be a solenoid with sliding rod. The direction of thrust or pull can be controlled through the electric current for the solenoid.

The adjusting device 31 can however also be in the form of a cylinder with piston, whereby the piston is connected to the thrusting rod. The movement of the piston can be controlled hydraulically or pneumatically.

The adjusting device 31 can however also function mechanically and the controls 33 can function as mechanically acting controls with control disks actuating a mechanical rod system going to the pressure roller lever.

Figure 4:
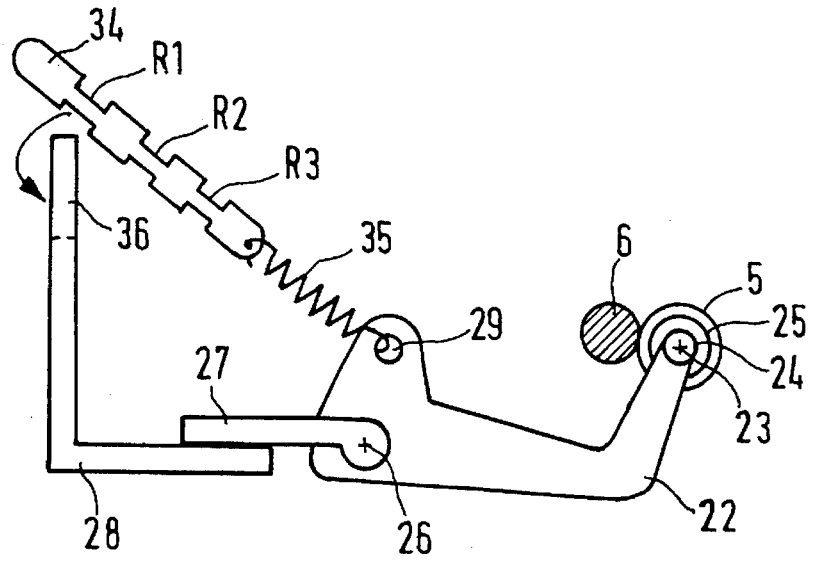
FIG. 4 shows a draw-off device with snap-in tongue and traction spring according to the invention.

Another very simple mechanical embodiment is shown in FIG. 4. The adjusting device 31 with thrusting rod 30 is replaced by a locking tab 34 with e.g. 3 locking recesses R1, R2 and R3 and with a tension spring 35 connected to the locking tab 34. The tension spring 35 is hooked with its free end into hole 29 of the pressure roller lever 22. The locking tab 34 can catch with a locking recess on the fork 36 of the angle bracket 28 and be immobilized. If three number ranges are defined, the tension spring 35 can be put under different tensions manually by snapping in one of the locking recesses R1, R2 or R3 into the fork 36, i.e. the contact pressure exerted by the tension spring 35 upon the pressure roller 5 can be adjusted manually as a function of the three locking recesses R1, R2, R3. If the possible number ranges are broken down into three groups, an adjustable contact pressure can be produced by appropriate sizing of the tension spring 35 and of the locking tab 34.

It will be apparent to those skilled in the art that various modifications and variations can be made in the present invention without departing from the scope and spirit of the invention. For example, features illustrated or described as part of one embodiment can be used on another embodiment to yield a still further embodiment. It is intended that the present invention cover such modifications and variations as come within the scope of the appended claims and their equivalents.

We claim:

1. A yarn draw off device for use with a spinning machine, said device comprising:

a pressure roller;

a rotatably driven draw-off shaft, said pressure roller in contact with said draw-off shaft and rotatably driven thereby whereby a yarn continuously produced in the spinning machine is draw off between said pressure roller and said draw-off shaft in a continuous yarn producing configuration of said spinning machine; and an adjustable mounting device for said pressure roller, said pressure roller rotatably mounted on said mounting device, said mounting device selectively movable relative to said draw-off shaft in said continuous yarn producing configuration, thereby providing selectable varied contact pressures between said pressure roller and said draw-off shaft in said continuous yarn producing configuration.

2. The device as in claim 1, wherein said mounting device is movable to a position so as to decrease the contact pressure between said pressure roller and said draw-off shaft for production of a thinner yarn number.

3. The device as in claim 1, wherein said mounting device is movable to a position so as to increase the contact pressure between said pressure roller and said draw-off shaft during piecing operations and is movable to a second position after completion of piecing operations so as to decrease contact pressure between said pressure roller and said draw-off shaft.

4. The device as in claim 1, further comprising an adjusting device operably configured with said mounting device for variably positioning said mounting device, and a control device operably configured with said adjusting device for remote continuous control of said adjusting device.

5. The device as in claim 4, wherein said adjusting device comprises a movable thrusting rod engaging with said mounting device.

6. The device as in claim 4, wherein said adjusting device comprises a tension spring connected to said mounting device and locking tabs engageable within a stationary locking recess, said locking tabs changing the tension of said tension spring and thus the contact pressure between said pressure roller and said draw-off shaft.

7. The device as in claim 1, wherein said mounting device comprises a pivotable pressure roller lever having a line of action through its pivot point, said line of action coinciding with a center line of a running surface of said pressure roller.

8. A spinning machine, comprising:

a yarn production device for spinning yarn;

a yarn draw off device configured for drawing continuously produced yarn off from said yarn production device in a continuous yarn production configuration of said yarn production device, said yarn draw-off device further comprising a pressure roller;

a rotatably driven draw-off shaft, said pressure roller in contact with said draw-off shaft and rotatably driven thereby whereby a yarn produced in the yarn production machine in said yarn production configuration thereof is draw off between said pressure roller and said draw-off shaft; and an adjustable mounting device for said pressure roller, said pressure roller rotatably mounted on said mounting device, said mounting device selectively movable relative to said draw-off shaft in said yarn producing configuration thereby providing selectable varied contact pressures between said pressure roller and said draw-off shaft in said yarn producing configuration.

9. The device as in claim 8, further comprising an adjusting device operably configured with said mounting device for variably positioning said mounting device, and a control device operably configured with said adjusting device for remote continuous control of said adjusting device.

10. The device as in claim 9, wherein said adjusting device comprises a movable thrusting rod engaging with said mounting device.

11. The device as in claim 9, wherein said adjusting device comprises a tension spring connected to said mounting device and locking tabs engageable within a stationary locking recess, said locking tabs changing the tension of said tension spring and thus the contact pressure between said pressure roller and said draw-off shaft.

12. The device as in claim 8, wherein said mounting device comprises a pivotable pressure roller lever having a line of action through its pivot point, said line of action coinciding with a center line of a running surface of said pressure roller.

* * * * *